United States Patent [19]

Hind et al.

[11] 3,980,271

[45] Sept. 14, 1976

[54] POURING OF MOLTEN METALS

[75] Inventors: Robert Duncan Hind, Rotherham; Jeffrey Hill, Oxspring, near Sheffield, both of England

[73] Assignee: United States Steel Corporation, Pittsburgh, Pa.

[22] Filed: Jan. 9, 1975

[21] Appl. No.: 539,665

[30] Foreign Application Priority Data

Jan. 16, 1974 United Kingdom ..... 2130/74

[52] U.S. Cl. ..... 251/144; 251/155; 222/567; 222/600

[51] Int. Cl.[2] ..... B22D 37/00

[58] Field of Search ..... 251/155, 144; 222/512, 222/561, 567, 566, DIG. 1, DIG. 6, DIG. 7, 600

[56] References Cited

UNITED STATES PATENTS

| | | | |
|---|---|---|---|
| 3,430,644 | 3/1969 | Lyman | 251/144 X |
| 3,567,082 | 3/1971 | Tinnes | 222/DIG. 7 |
| 3,685,705 | 8/1972 | Gessna | 222/561 X |
| 3,831,857 | 8/1974 | Scott | 222/567 X |
| 3,841,539 | 10/1974 | Shapland, Jr. | 251/144 X |
| 3,845,943 | 11/1974 | Shapland | 222/567 X |

*Primary Examiner*—Martin P. Schwadron
*Assistant Examiner*—Robert J. Miller
*Attorney, Agent, or Firm*—Walter P. Wood

[57] ABSTRACT

The sliding plate of a sliding gate valve has a mounting for a collector nozzle, and a nozzle is releasably coupled to the mounting by means of a releasable fastening which allows ready replacement of the nozzle when worn. The releasable fastening clamps the collector nozzle to its mounting and holds the nozzle in firm abutment with the underside of the sliding plate.

25 Claims, 4 Drawing Figures

POURING OF MOLTEN METALS

Figure 1:
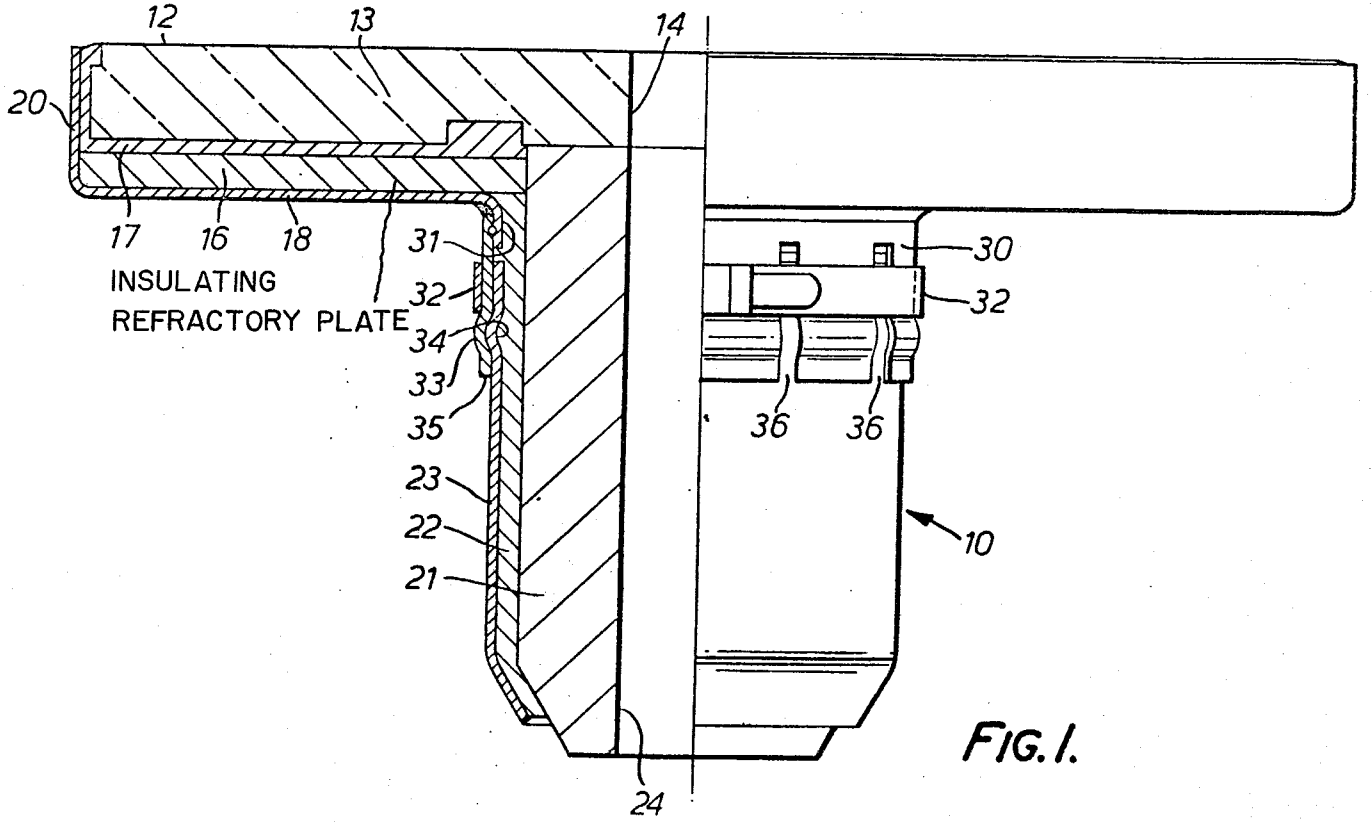

The present invention relates to improvements in and relating to the pouring of molten metals.

Pouring metals from holding vessels such as ladles or tundishes through bottom or side-pour openings fitted with discharge nozzles is accompanied by rapid nozzle deterioration.

The deterioration can consist of nozzle blockage or erosion. Periodical replacement of nozzles is therefore necessary, and this is a task which is time-consuming, inconvenient and costly.

The broad aim of this invention is to simplify and facilitate nozzle replacement in relation to sliding gate valves, which are now commonly used to control, for example, the flow of molten steel from a bottom pour-ladle or tundish.

Sliding gate valve assemblies generally comprise a sliding gate member having a nozzle, which is arranged to slide in contact with a stationary orifice plate. Examples of such sliding gate valve assemblies are described in Shapland Reissue U.S. Pat. No. Re 27,237 and U.S. Pat No. 3,501,068, Shapland et al. application Ser. No. 377,385 filed July 9, 1973, and Cudby application Ser. No. 380,808, filed July 19, 1973. The foregoing patents and applications are concerned with arrangements in which the sliding gate member is linearly reciprocable. In an alternative arrangement the sliding gate is rotary and one example of this is described in Lyman U.S. Pat. No. 3,430,644. The foregoing patents and applications and the present application are of common ownership.

According to the present invention, there is provided a sliding plate for a sliding gate valve, wherein an apertured nozzle mounting is attached to the underside of the plate and a collector nozzle tube depends therefrom, the nozzle tube is cemented into an encasing metal sleeve, and securing means fastens the metal sleeve and the nozzle mounting together such that an end of the nozzle tube is held directly abutting the underside of the plate, the securing means being releasable to allow the nozzle tube to be detached from the plate for replacement. It will be understood that the underside of the sliding plate is the face thereof remote from the surface which slides in contact with the stationary orifice plate. Under mounting the nozzle tube in direct abutment as aforesaid is intended to prevent molten metal "finning", i.e. solidifying between the tube and the nozzle mounting.

The nozzle mounting can comprise an apertured metal reinforcing pan or tray which is secured to the plate.

The releasable securing means can comprise a screw-threaded connection between the nozzle sleeve and the nozzle mounting. Accordingly, the sleeve can be secured to the nozzle mounting by a plurality of screws, for example self-tappers, or screws which enter captive nuts or threaded apertures. The nozzle sleeve is provided with an apertured flange or lugs for receiving the screws or bolts.

Another screw-threaded connection can comprise two interfitting screw threads formed in or associated with the nozzle mounting and the nozzle sleeve respectively. The screw threads can be provided as integral formations in mating portions of the mounting and sleeve. In an embodiment to be described, however, the screw threads are defined by wavy surfaces formed in two shaped metal rings, one ring being fast with the nozzle mounting and the other ring fast with the nozzle sleeve.

Alternatively, the releasable fastening means can comprise a clip or clamp coupling between the nozzle mounting and the nozzle sleeve. In a preferred embodiment, the coupling includes an attachment ring secured to the nozzle mounting, the ring being compressed about the nozzle sleeve by means of a strap or buckle. In this embodiment, the attachment ring is welded to a encircling lip around the aperture in the nozzle mounting, namely, in the gate plate reinforcing tray, the ring being slotted in an axial direction to allow the ring to give radially.

Conveniently, the attachment ring and the nozzle sleeve include means serving to locate the nozzle positively with respect to the sliding plate. The locating means can comprise an arrangement of inter-fitting projections and recesses upon the nozzle sleeve and the attachment ring. For example, the sleeve can include an encircling rib for mating with a corresponding recess formed internally in the ring. The recess can be defined by a pressed-out encircling rib on the ring.

Optionally, the cement bond between the nozzle tube and the nozzle sleeve is frangible to allow the tube to be detached from the sleeve. Then, the sleeve can be reused when a defective nozzle tube is replaced by a new tube.

Another advantageous embodiment incorporates a bayonet type of coupling as the securing means. This embodiment is designed to facilitate on-site servicing so that nozzle replacement can be effected without removal of the sliding plate from the valve.

Accordingly, the invention provides a sliding plate for a sliding gate valve, wherein an apertured nozzle mounting is attached to the underside of the plate and a collector nozzle tube depends therefrom, the nozzle mounting including a metal sleeve into which a collector nozzle tube is releasably cemented, and a releasable bayonet coupling is provided to lock the nozzle tube to the metal sleeve, the arrangement being such that after releasing the bayonet coupling, it is possible to withdraw the nozzle tube from the sleeve for replacement by a new nozzle tube.

This application also comprehends a sliding gate valve incorporating a gate plate fitted with a replaceable nozzle assembly having features embodying the invention.

This application further comprehends a vessel such as a ladle or tundish incorporating a bottom-pour opening fitted with a replaceable nozzle assembly having features embodying the invention.

Figure 2:
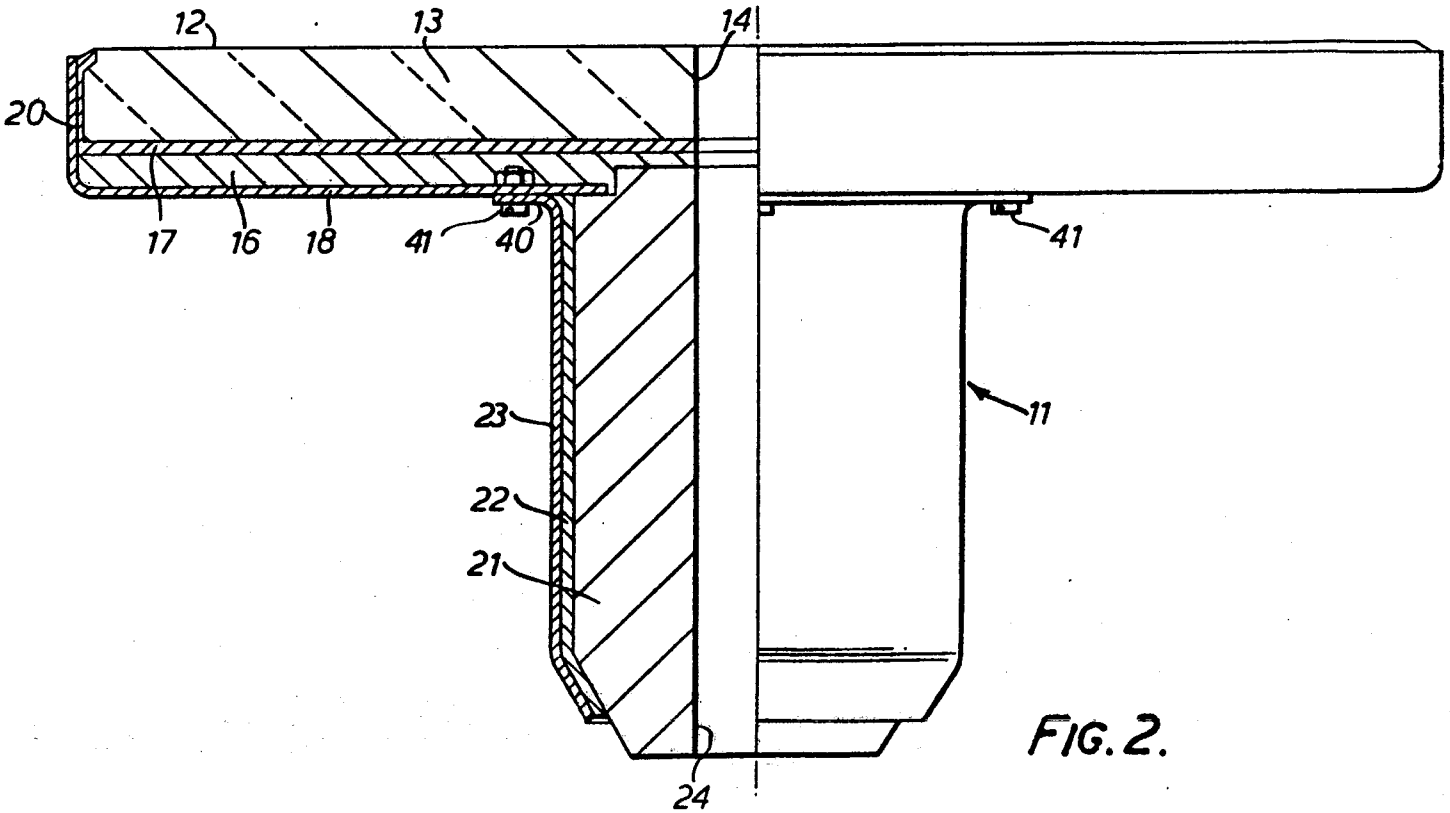
Figure 3:
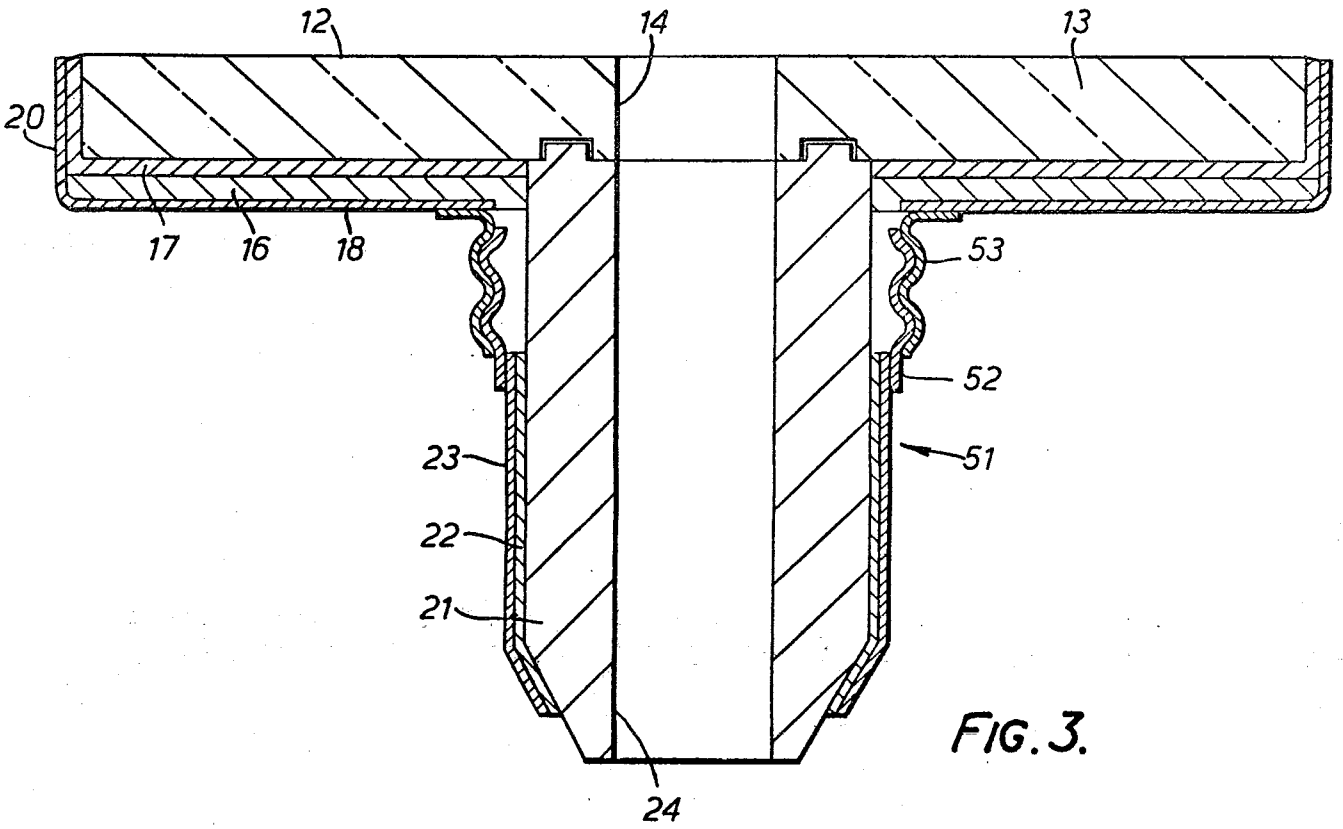
Figure 4:
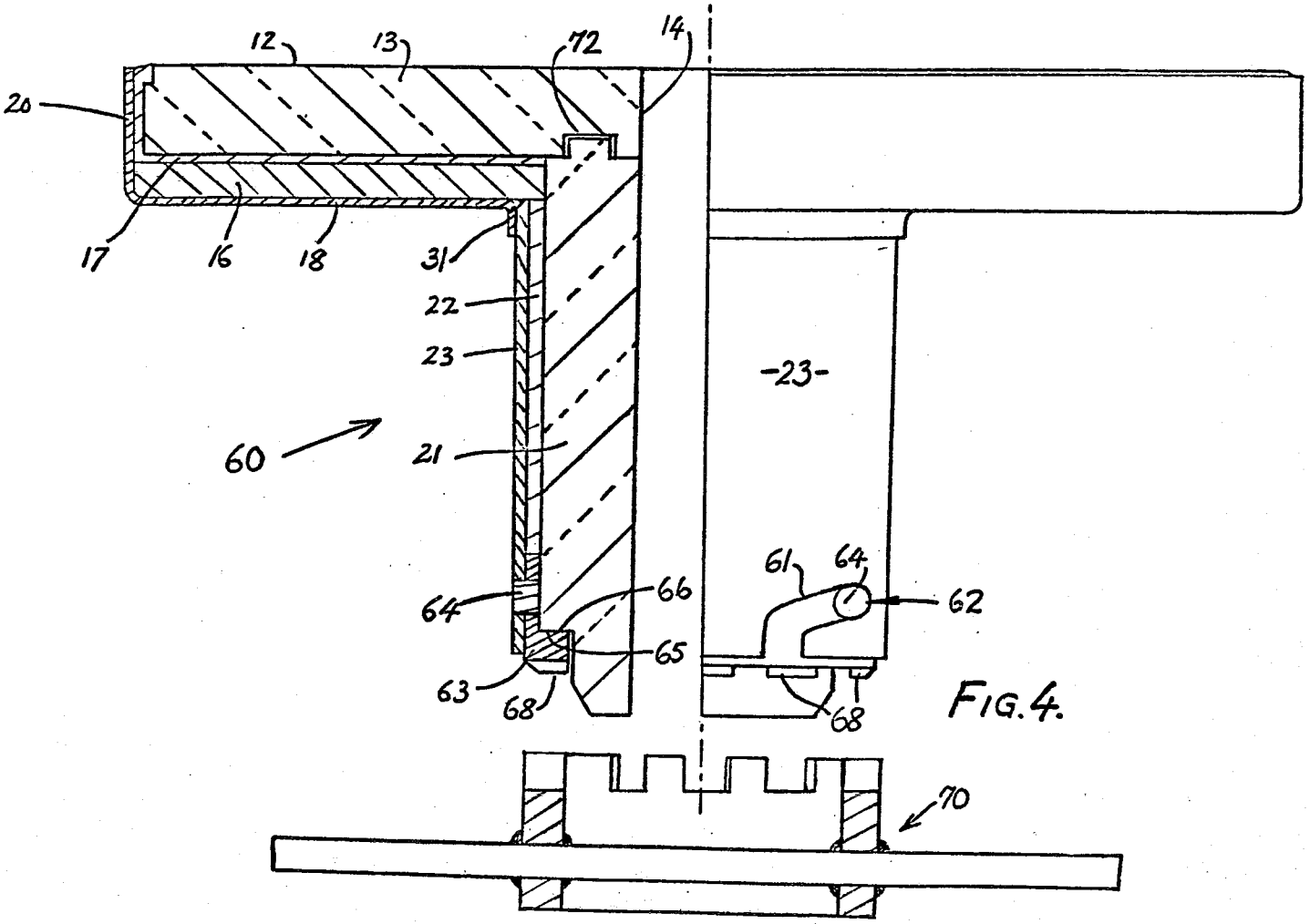

The present invention will now be described by way of example with reference to the accompanying drawings, in which:

FIG. 1 shows a sliding gate valve gate plate fitted with a replaceable collector nozzle embodying the invention, the drawing being partly in perspective and partly in section, FIG. 2 shows a second embodiment of the present invention in a similar manner, FIG. 3 shows a third embodiment of the present invention in a similar manner, and FIG. 4 shows a fourth embodiment of the present invention in a similar manner.

The drawings show alternative replaceable metal discharge or collector nozzles 10, 11, 51 for sliding gate valves. The valves are not shown in their entirety; such valves are known and examples thereof are to be found in the patent specifications referred to earlier.

A sliding gate valve includes a movable, sliding gate plate 12 which is held in face-to-face contact with a stationary orifice plate (not shown). The gate plate 12 is slidable in contact with the orifice plate selectively to present the collector nozzle 10, etc. in and out of registry with the orifice to open and close the valve.

The gate plate 12 comprises a main upper refractory portion 13 having an orifice 14 therein. The main portion 13 can be composed of a high density, abrasion resistant aluminous refractory containing say 85–90% $Al_2O_3$.

An apertured insulating plate 16 is secured by heat or air setting cement 17 to the underside of the main portion 13. The plate 16 can be composed of a fireclay refractory. A metal, e.g. stee, tray 18 is fitted to the underside of the plate 16, the tray 18 having an upstanding rim 20 which is cemented to the periphery of the gate plate 12. The tray 18 is adapted to form an attachment for the nozzle 10, etc.

The nozzle 10, etc. comprises a thick-walled refractory tube 21 which is cemented at 22 into a metal sleeve 23, for example of steel. The tube has a bore 24 equal in diameter to the orifice 14, the bore 24 being co-axial therewith. The nozzle tube 21 can be composed of any of the refractory materials commonly in use for this purpose. For example, the tube can be made of a fireclay such as a fired, low density 40% $Al_2O_3$, or a high density 85–90% alumina, or zirconia.

If desired, the nozzle tube 21 can take the forms disclosed in our co-pending patent application Ser. No. 517,352 filed Oct. 23, 1974, of common ownership.

FIGS. 1 and 2 show two alternative ways of detachably securing the collector nozzles 10, 11 to the gate plate 12. In each case, the nozzle is undermounted.

In FIG. 1, the nozzle 10 is clamped within an attachment ring 30 which is welded to a circular lip 31 of the tray 18, the lip being concentric with the orifice 14. The attachment ring 30 is held tightly encircling the sleeve 23 by a buckle 32. The buckle 32 can be of a known type incorporating a metal strap. As an example, it could be a "Jubilee" clip or metal strapping applied with a known tool.

The attachment ring 30 has an encircling protrusion or rig 33 forming an internal recess which mates with a corresponding protrusion or rib 34 formed in the exterior of the sleeve 23. The rib 33 is located adjacent the entry end 35 of the ring 30. The ribs, 33, 34 serve to provide positive locating means for the nozzle 10. The ring 30 is slotted at intervals around its circumference in an axial direction, as shown at 36, to enable the ring to give radially. The slots 36 allow the ring to expand or open and then to close as the rib 34 is moved towards and into its accommodating recess when installing the nozzle 10. The nozzle 10 is fitted with its upper end abutting the underside of the gate plate 12. It will be understood that removal of the nozzle 10 for replacement when worn or blocked is preceded by unfastening of the buckle 32.

In the alternative construction shown in FIG. 2, the nozzle 11 is secured to the gate plate 12 by screwing or bolting. In this case, the metal sleeve 23 has an outwardly-directed flange 40 encircling its upper end. The flange 40 is apertured at intervals around its periphery for bolts 41 to pass therethrough. The bolts 41 pass through the tray 18 and are screwed into nuts located on the upper surface of the tray 18. Desirably, the nuts are welded or brazed to the tray 18.

It will be recognised that the bolts 41 could be screwed directly into capitive nuts or screw-threaded apertures in the tray 18, and that they could be replaced by self-tapping screws.

It will be noticed that the nozzle tube 21 has a stepped upper end surface which snugly fits in a correspondingly stepped portion of the underside of the insulating plate 16.

A further, alternative construction embodying a screw-threaded connection between the nozzle sleeve 23 and the nozzle mounting is shown in FIG. 3. Parts of the FIG. 3 embodiment which correspond to similar parts of the FIGS. 1 and 2 embodiments have like reference numbers. In FIG. 3, the screw-threaded connection is obtained by means of a pair of shaped metal rings 52, 53, each ring having a wavy wall defining a screw thread. In this instance, ring 52 screws into ring 53 and is welded or similarly affixed to the nozzle sleeve 23, whilst ring 53 is similarly affixed to the underside of the metal tray 18. By a minor modification, the structure embodied by the rings 52, 53 can be incorporated in mating portions of the nozzle sleeve and the nozzle mounting, the said portions being integral parts of their associated members.

A further embodiment has been designed to facilitate on-site servicing, so that removal of the nozzle is possible without it being necessary to remove the sliding plate from the valve mechanism. This embodiment uses a bayonet-type coupling as the securing means.

The further embodiment 60 will now be described in greater detail with reference to FIG. 4. In this case, there is a cylindrical metal sleeve 23 which is welded or brazed to the circular lip 31 of the tray 18. The end of the sleeve 23 remote from the tray 18 has a plurality, e.g. two, slots 61 which form one half of a bayonet-type coupling 62. The nozzle tube 21 is cemented in the sleeve 23 and is provided with the other half of the bayonet type-coupling. The said other half comprises a ring 63 provided with pins 64 to engage the sleeve slots 61, the ring being counterbored to provide a ledge 65 to abut a circumferential shoulder 66 formed at the lower end of the nozzle tube 21.

It is preferred to provide the ring with means to enable a torque tool or spanner to grip the ring; the said means can comprise castellations 68 for engagement with a suitably castellated spanner 70.

Installation of the nozzle tube 21 proceeds as follows. A layer 22 of graphitized cement or other readily-frangible cement is first applied to the outer surface of the tube 21. The cement-covered tube 21 is then inserted into the metal sleeve 23. The bayonet coupling ring 63 is next slipped over the shouldered lower end of the tube 21 and its pins 64 are engaged with the bayonet slots of the sleeve 23. The ring 63 is then turned with the torque tool 70 to secure the bayonet coupling 62 and thereby lock the nozzle tube 21 in place while the cement sets. The coupling 62 is so designed that a securing rotation of the ring 63 causes the ring to move axially towards the sliding plate 12 to urge the remote end of the nozzle tube 21 into firm abutment with the sliding plate 12. The said remote end of the nozzle tube 21 is desirably stepped as shown at 72, the plate 12 having a corresponding stepped formation to define a seating therefor.

When it is necessary to replace the nozzle tube 21, all that has to be done is to release the bayonet coupling 62 using the torque tool 70. The nozzle tube 21 can then be forcibly withdrawn by pulling away from the sliding plate 12, the cement bond being readily frangible for this reason. It will be appreciated that nozzle tube removal, as well as installation, can be carried out without detaching the sliding plate 12 from the valve mechanism.

After removal of the old nozzle tube 21, a new tube can be installed as described above.

In the illustrated bayonet coupling, the pins 64 are carried by the ring 63 and the slots 61 are formed in the sleeve 23. The pin and slot locations could be interchanged so that the pins are carried instead by the sleeve 23.

It is not essential for the nozzle tube 21 to have the form shown in the drawings. The tube could, inter alia, take the form which is described in the aforementioned application Ser. No. 517,352, particularly if steels which are deoxidised or "killed" or if rimming or grain-refined steels are to be poured.

Accordingly, the liner could comprise a main tubular refractory body the inner wall of which is lined by a second refractory material which has greater resistance to slag and molten metal attack and erosion than the main body, the second refractory material extending at least half-way along the liner from the end thereof which is flush with the sliding surface of the plate member. The second refractory material of the liner may have a heat capacity of the same order as fireclay and could comprise zirconia, zircon or materials containing zirconia or zircon.

If desired, the nozzle tube could take other forms, as will be appreciated by the addressee. For example the tube could have a gas-permeable side wall and gas inlet as disclosed in co-pending patent application Ser. No. 524,916, filed Dec. 18, 1974, of common ownership.

We claim:

1. A sliding plate for a sliding gate valve, comprising an apertured main upper refractory portion, an apertured nozzle mounting encasing said main portion and underlying the understood thereof, a collector nozzle tube which depends from said nozzle mounting, a metal sleeve encasing said nozzle tube and cemented thereto, and securing means fastening said metal sleeve and said nozzle mounting together such that an end of said nozzle tube is held in direct abuttment with the underside of said main portion, said securing means being releasable to allow said nozzle tube to be detached from said main portion for replacement.

2. A sliding main portion according to claim 1, wherein said nozzle mounting comprises an aperture metal reinforcing pan or tray secured to said plate.

3. A sliding plate according to claim 1, wherein said releasable securing means comprises screw-threaded connecting means.

4. A sliding plate according to claim 3, wherein said connecting means comprise two interfitting screw threads associated with said nozzle mounting and said nozzle sleeve respectively.

5. A sliding plate according to claim 4, wherein said two interfitting screw threads are defined by wavy surfaces formed in two shaped metal rings, one ring being fast with said nozzle mounting and the other ring fast with said nozzle sleeve.

6. A sliding plate according to claim 1, wherein said releasable fastening means comprises a clamp coupling between said nozzle mounting and said nozzle sleeve.

7. A sliding plate according to claim 6, wherein said coupling comprises an attachment ring secured to said nozzle mounting and a strap for compressing said attachment ring about said nozzle sleeve.

8. A sliding plate according to claim 7, wherein said attachment ring is welded to an encircling lip around the said aperture in the nozzle mounting.

9. A sliding plate according to claim 7, wherein said ring is slotted in an axial direction to allow the ring to give radially.

10. A sliding plate according to claim 7, wherein said attachment ring and said nozzle sleeve include means serving to locate said nozzle positively with respect to said main portion.

11. A sliding plate according to claim 10, wherein said locating means comprise an arrangement of interfitting projections and recesses upon said ring and said sleeve.

12. A sliding plate according to claim 1, wherein said releasable securing means comprises a bayonet coupling.

13. A sliding plate for a sliding gate valve, comprising an apertured main upper refractory position, an apertured nozzle mounting encasing said main portion and underlying the underside thereof, a collector nozzle tube which depends from said nozzle mounting, said nozzle mounting including a metal sleeve into which a collector nozzle tube is releasably cemented, and a releasable bayonet coupling to lock said nozzle tube to said metal sleeve, and hold an end of said nozzle tube in direct abutment with the underside of said main portion, whereby after releasing said bayonet coupling, it is possible to withdraw said nozzle tube from said sleeve for replacement by a new nozzle tube.

14. A sliding plate according to claim 13, wherein one half of the bayonet coupling comprises the metal sleeve and the other half of said coupling comprises a locking ring engageable with the nozzle tube.

15. A main portion according to claim 14, wherein the end of said nozzle tube remote from said sliding plate has a shoulder providing an abutment for said locking ring.

16. A sliding plate according to claim 13, wherein said bayonet coupling is adapted to urge said nozzle tube firmly against said main portion as said coupling is operated to secure the nozzle tube to said main portion.

17. A sliding plate according to claim 15, wherein said locking ring is provided with bayonet pins and the end of the said metal sleeve remote from said main portion is provided with a corresponding number of bayonet slots to receive said pins.

18. A sliding plate according to claim 15, wherein said locking ring has engagement means co-operable with a locking tool.

19. A sliding plate according to claim 18, wherein said engagement means comprises a castellated formation.

20. A sliding plate according to claim 1, wherein the underside of said main portion is underlain by an insulating refractory plate which forms an integral part of said sliding plate.

21. A sliding plate according to claim 1, wherein said end of the nozzle tube is stepped and the underside of said main portion is shaped to mate therewith.

22. A sliding plate according to claim 1, wherein the cement bond between said nozzle tube and said nozzle sleeve is frangible to allow the said tube to be detached from said metal sleeve.

23. A sliding gate valve including a sliding plate as claimed in claim 1.

24. A vessel such as a ladle or tundish having a sliding gate valve according to claim 23 fitted thereto.

25. A method of installing a nozzle tube in a sliding plate, the tube and plate being of a construction as defined in claim 13, said method comprising:

applying a layer of frangible cement to the outer surface of said nozzle tube;

inserting the cement covered tube into said metal sleeve;

securing said bayonet coupling to lock said tube in said sleeve; and setting said cement.

* * * * *

UNITED STATES PATENT OFFICE

CERTIFICATE OF CORRECTION

Patent No. 3,980,271 Dated September 14, 1976

Inventor(s) Robert Duncan Hind et al.

It is certified that error appears in the above-identified patent and that said Letters Patent are hereby corrected as shown below:

Column 3, line 17, "stee" should read -- steel --.

Column 5, line 42, "understood" should read -- underside --,

Column 5, line 51, "main portion" should read -- plate --; line 53, "plate" should read -- main portion --.

Column 6, line 23, "position" should read -- portion --.

Column 6, line 39, "main portion" should read --sliding plate --; line 39, "claim 14" should read -- claim 13 --; line 40, "sliding plate" should read -- main portion --.

Column 6, line 47, "claim 15" should read -- claim 13 --.

Column 6, line 52, "claim 15" should read -- claim 13 --.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*